United States Patent [19]

Moody

[11] Patent Number: 4,805,896

[45] Date of Patent: Feb. 21, 1989

[54] LOW RISE WATER RIDE

[76] Inventor: James C. Moody, 1758 Woodway Dr., New Caney, Tex. 77357

[21] Appl. No.: 111,676

[22] Filed: Oct. 23, 1987

[51] Int. Cl.[4] ..... A63G 21/18

[52] U.S. Cl. ..... 272/56.5 R; 104/70

[58] Field of Search ..... 272/1 B, 32, 56.5 R, 272/56.55 S, 1 A; 104/58, 59, 63, 69, 70, 134, 72, 73; 405/79, 118, 119; 193/2 R, 2 A, 25 E; 182/40, 41, 48–52

[56] References Cited

U.S. PATENT DOCUMENTS

| | | | |
|---|---|---|---|
| 419,860 | 1/1890 | Libbey | 272/56.5 R |
| 548,256 | 10/1895 | Idler | 104/70 |
| 572,426 | 12/1896 | Idler | 104/70 |
| 654,980 | 7/1900 | Howard | 272/56.5 R X |
| 3,923,301 | 12/1975 | Meyers | 272/56.5 R |
| 4,149,710 | 4/1979 | Rouchard | 272/56.5 R |
| 4,194,733 | 3/1980 | Whitehouse, Jr. | 272/56.5 R |
| 4,196,900 | 4/1980 | Becker et al. | 272/56.5 R |
| 4,198,043 | 4/1980 | Timbes et al. | 272/56.5 R |
| 4,278,247 | 7/1981 | Jodde et al. | 272/56.5 R |
| 4,337,704 | 7/1982 | Becker et al. | 104/70 |

*Primary Examiner*—David A. Scherbel
*Assistant Examiner*—Richard E. Chilcot, Jr.
*Attorney, Agent, or Firm*—Neal J. Mosely

[57] ABSTRACT

A water ride for swimmers utilizes the linear movement of a large quantity of water of swimming depth at minimal slopes so that the swimmer is moved by the water rather than through it. High volume pumps at low water heads move large quantities of water to create varying water velocity characteristics. A circuitous course is configured generally in the form of an S-curve with a complete 360° circular portion at the bottom with a straight connecting portion from the circle to the top of the S-curve. Water is pumped through the S-curve and connecting portion at a one rate and through the circular portion at another rate. The continuous channel varies along its length in depth, width, slope, and curvature to vary the velocity and flow characteristic of the flowing water. Entrances and exits are provided on the straight connecting portion and on the circular portion. The main entrance on the straight portion is less than 7 feet above the main entrance on the circular portion. A reservoir within the circular portion of the channel supplies water for the channel and is also used for swimming, wading, sunbathing, diving and other water recreation. The circular channel empties into the reservoir and an inclined walk way from the reservoir leads back to the main entrances on the circular portion and on the straight connecting portion.

28 Claims, 6 Drawing Sheets

(ENTRANCE TO A1)

(BIFURCATED CHUTES A2)

(A3-A4)

(A5-A6-A7)

(A7-B20)

(B1-B2-B3, B12-B13, B14)

(B1-B2-B3, B12-B13-B14)

(B4-B10-B19)

(B6)

LOW RISE WATER RIDE

BACKGROUND OF THE INVENTION

1. Field of the Invention

This invention relates generally to amusement devices, and more particularly to a low rise water ride utilizing high volume pumps at low water heads to move large quantities of water from one or more minimal elevations through a circuitous channel configuration to create varying water velocity characteristics.

2. Brief Description of the Prior Art

The recreational sport and entertainment of "tubing" or riding a river wherein the participants float down a stream of water and are subjected to rapids and various other changes in the water speed and currents is very popular. Early man-made water entertainment devices utilized boat structures which are moved seriatim through a tank or channel by a mechanical attachment to provide entertainment of participants. Recently, large amusement park "water ride" structures have been developed, wherein the participants experience the instability associated with pure flotation. Most water ride structures utilize a small amount of water running down highly elevated slides where the force of gravity propels the participants at a fast rate through a curved channel. As a result, the participants often spend more time walking back to the elevated slide entrance and waiting in lines than actually enjoying the ride.

There are several patents which disclose various water amusement rides.

Pickard, U.S. Pat. No. 448,072 discloses a continuous canal divided longitudinally by a wall partition and provided with a propeller wheel for forcing the water from one side of the canal into the other side to set up a continuous current.

Boyton, U.S. Pat. No. 640,439 and Schofield, U.S. Pat. No. 664,179 disclose pleasure canals having a sinuous path with the ends being contiguous. The canal is at a high elevation at the beginning and at a lower elevation at the end and has a downward gradient from the former to the latter. A pump or water wheel maintains a continuous current in the canal and transfers water from the lower level to the higher level. Boats are conveyed from one basin to the other by an endless belt or series of rollers.

Du Clos, U.S. Pat. No. 757,286 discloses a continuous artificial canal with various convolutions and having a gradual fall from the entrance to the exit point. Water is pumped from the low level to the high level and when the pump is not running, the water flows into an artificial lake which is used to fill the canal when the pump is running. Water may also be injected by this pump into the canal at various points to accelerate its movement. Another pump takes water from the lake and elevates it to a roof where it is discharged over the roof in the form of an artificial waterfall. An elevator lifts boats from the low level to the high level.

Bacon et al, U.S. Pat. No. 3,404,635 discloses a boat amusement ride having a continuous waterway with a section that is bifurcated into two branches and each branch having a passenger loading station. The cross sectional area of the waterway is increased and the depth is reduced in the bifurcated area to maintain a more nearly constant water velocity Lippincott, U.S. Pat. No. 1,926,780 discloses an endless water course with nozzle headers in the walls of each side to produce current in and throughout the course. The nozzle headers are constructed of pipe which is slit from end to end. When the pump is actuated, a stream will emerge from the slits as a sheet of water as wide as the header is long. The course may include a sled water slide and the participants can coast round and round the water course on the current until an attendant manipulates a gate to obstruct the course and shunt the current and the participants on their sleds into an obtuse landing compartment and onto a landing dock.

Symons, U.S. Pat. No. 3,930,450 discloses a boat ride which includes a main channel and an auxiliary channel extending underneath the main channel and isolated from it except for a narrow slot. The boat hull floats in the main channel and a paddle extends from the hull into the auxiliary channel. Water pumped along the auxiliary channel pushes the paddles to move the boats along the main channel.

Barber, U.S. Pat. No. 4,429,867 discloses a portable amusement device wherein flotation of participants occurs on a continuous basis within a trough formed of segments which are nested for shipping and storage and joined to one another in use to form a continuous trough.

The present invention is distinguished over the prior art and these patents in particular by a water ride for swimmers which utilizes the linear movement of a large quantity of water of swimming depth at minimal slopes so that the swimmer is moved by the water rather than through it. High volume pumps at low water heads move large quantities of water to create varying water velocity characteristics. A circuitous course is configured generally in the form of an S-curve with a complete 360° circular portion at the bottom with a straight connecting portion from the circle to the top of the S-curve. Water is pumped through the S-curve and connecting portion at a one rate and through the circular portion at another rate. The continuous channel varies along its length in depth, width, slope, and curvature to vary the velocity and flow characteristic of the flowing water. Entrances and exits are provided on the straight connecting portion and on the circular portion. The main entrance on the straight portion is less than 7 feet above the main entrance on the circular portion. A reservoir within the circular portion of the channel supplies water for the channel and is also used for swimming, wading, sunbathing, diving and other water recreation. The circular channel empties into the reservoir. An inclined walk way from the reservoir leads back to the main entrances on the circular portion and on the straight connecting portion.

SUMMARY OF THE INVENTION

It is therefore an object of the present invention to provide a safe, entertaining and exciting water ride in which participants may experience a variety of water characteristics while being propelled by moving water through a circuitous channel.

It is another object of this invention to provide a water ride which utilizes the movement of large quantities of water at minimal elevations to move the participants at predetermined velocities through a circuitous channel configuration.

It is another object of this invention to provide a water ride which moves large quantities of water a minimal elevation utilizing high volume horizontal pumps to create a large stream of fast moving water through a circuitous channel having changing depths and widths.

Another object of this invention is to provide a water ride in which fast moving zones of water movement are followed by slow moving water zones for recovery.

Another object of this invention is to provide a water ride in which the exit terminates near the entrance and allows the participants to slowly float back to the entrance thereby eliminating long walks back to the entrance and waiting in lines.

A further object of this invention is to provide a water ride having a circuitous channel which surrounds a pond area or reservoir which is the source of water for the ride and which is also used for swimming, diving and other water recreation.

A still further object of this invention is to provide a low rise water ride which is safe, trouble free, and economical in operation.

Other objects of the invention will become apparent from time to time throughout the specification and claims as hereinafter related.

The above noted objects and other objects of the invention are accomplished by the present water ride for swimmers which utilizes the linear movement of a large quantity of water of swimming depth at minimal slopes so that the swimmer is moved by the water rather than through it. High volume pumps at low water heads move large quantities of water to create varying water velocity characteristics. A circuitous course is configured generally in the form of an S-curve with a complete 360° circular portion at the bottom with a straight connecting portion from the circle to the top of the S-curve. Water is pumped through the S-curve and connecting portion at a one rate and through the circular portion at another rate. The continuous channel varies along its length in depth, width, slope, and curvature to vary the velocity and flow characteristic of the flowing water. Entrances and exits are provided on the straight connecting portion and on the circular portion. The main entrance on the straight portion is less than 7 feet above the main entrance on the circular portion. A reservoir within the circular portion of the channel supplies water for the channel and is also used for swimming, wading, sunbathing, diving and other water recreation. The circular channel empties into the reservoir and an inclined walk way from the reservoir leads back to the main entrances on the circular portion and on the straight connecting portion.

The water ride in accordance with the present invention is unique in comparison to existing water rides because it elevates much larger quantities of water at a greater rate to a much lower elevation. It utilizes the massive weight of that water with very gradual slopes to create the desired velocities. The smaller the slope, the lower the elevation, resulting in less power required and costs to operate making the installation of such a water ride economically feasible.

DESCRIPTION OF THE PREFERRED EMBODIMENT

Figure 1:
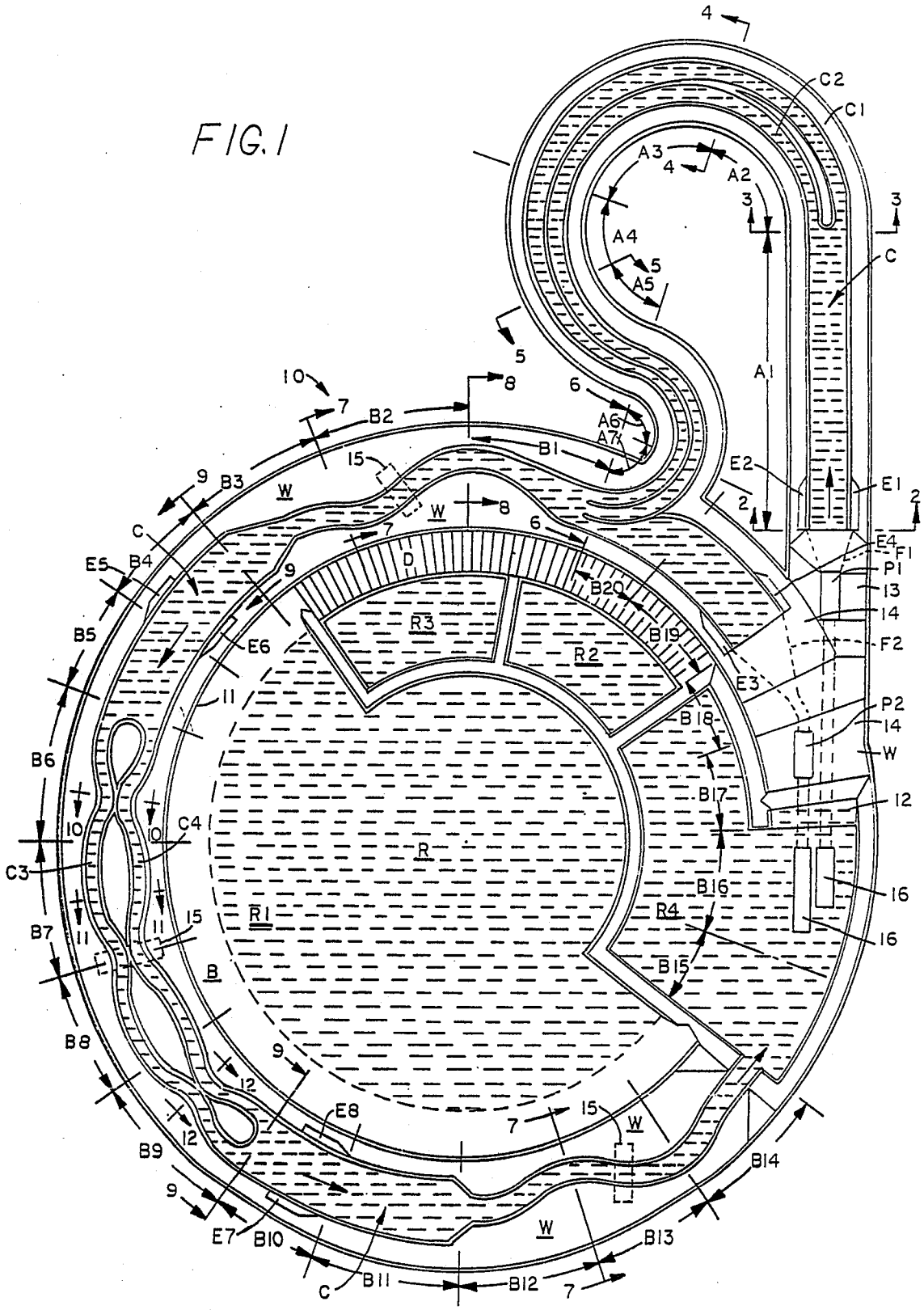
FIG. 1 is a top plan view of a preferred low rise water ride in accordance with the present invention.
Figure 2:
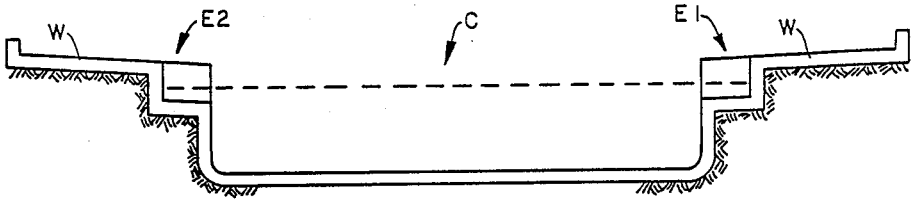
FIGS. 2 through 12 are transverse cross sections through the channel configuration of FIG. 1.
Figure 3:
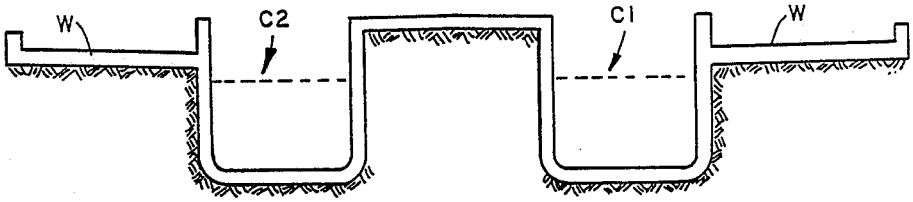
Figure 4:
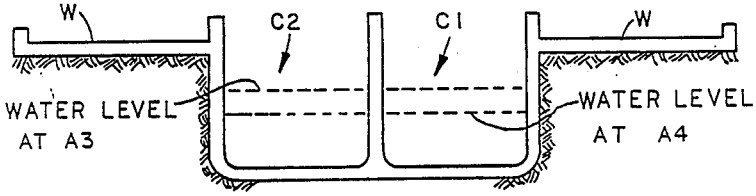
Figure 5:
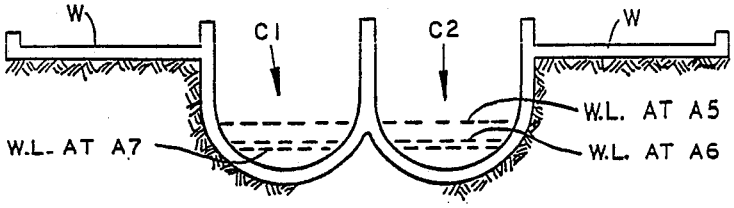
Figure 6:
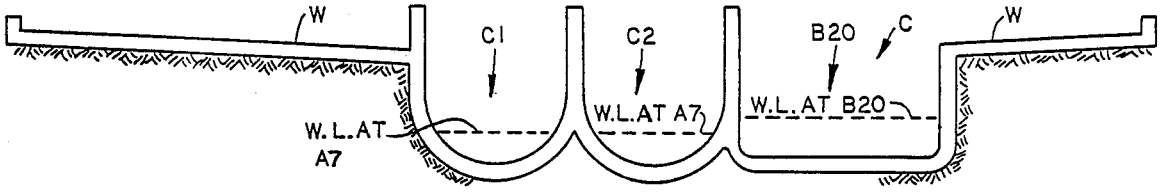
Figure 7:
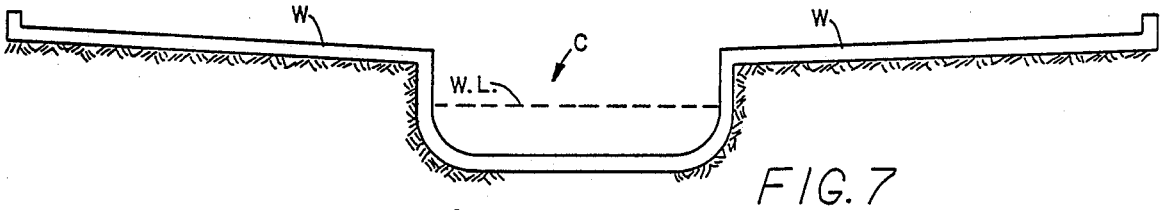
Figure 8:
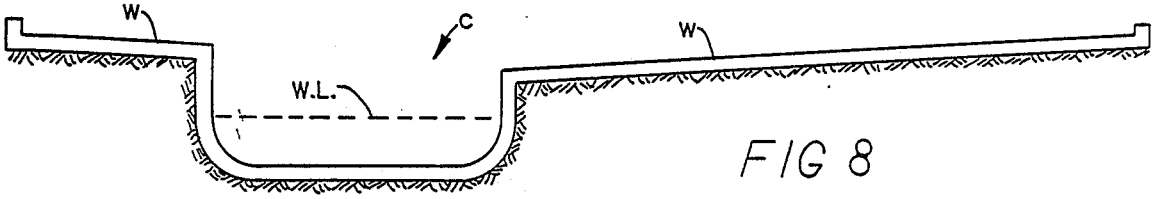
Figure 9:
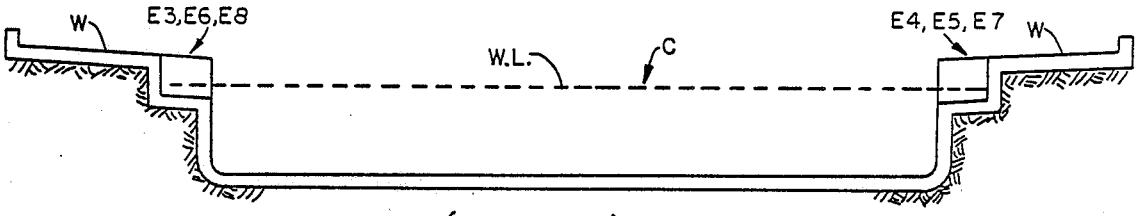
Figure 10:
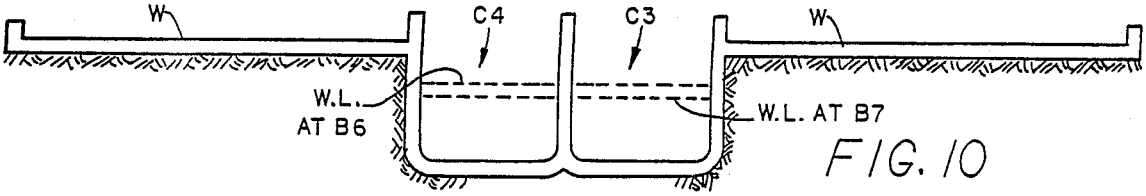
Figure 11:
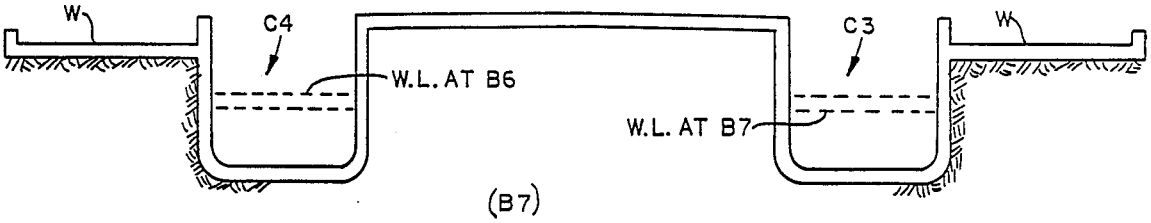
Figure 12:
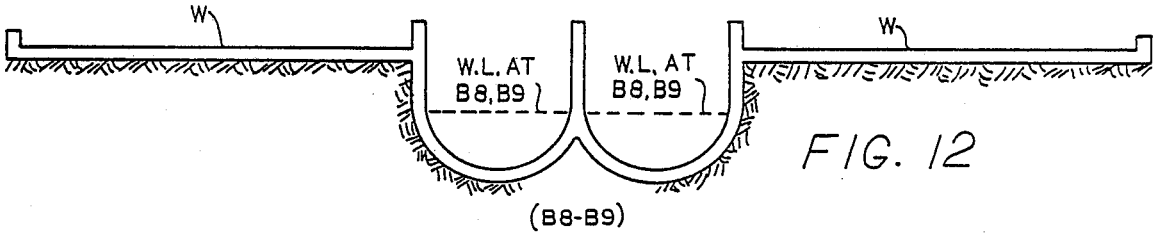
Figure 21:
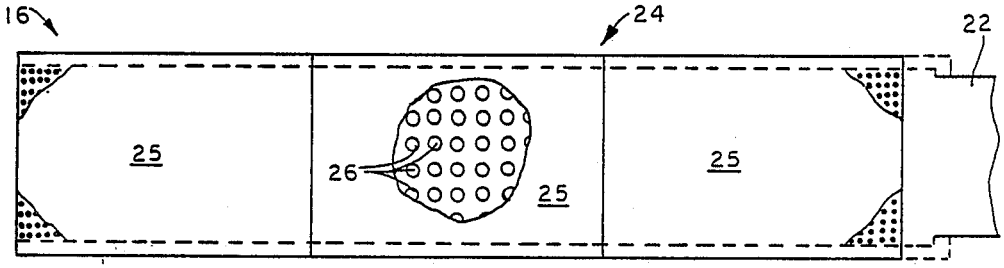
FIG. 21 is a top plan view of the inlet pit of FIG. 20.
Figure 20:
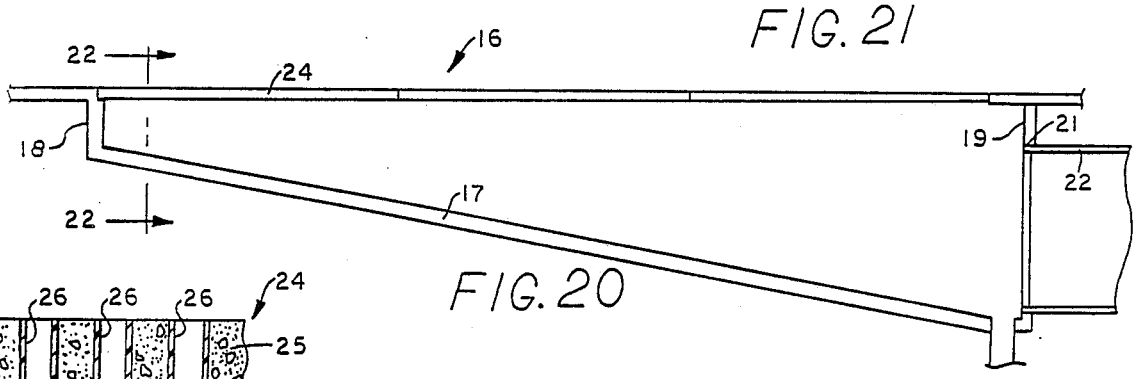
FIG. 20 is a side view in cross section through a pump inlet pit of the low rise water ride.
Figure 24:
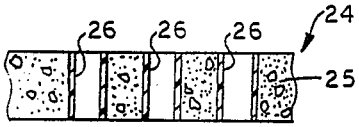
FIG. 24 is a partial longitudinal cross section through the lid member of the inlet pit of FIG. 13.
Figure 22:
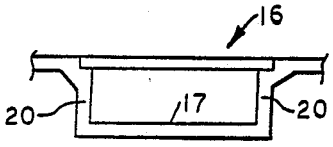
FIG. 22 is a cross section through the shallow end of the inlet pit of FIG. 20.
Figure 23:
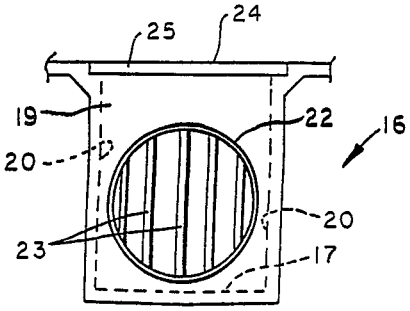
FIG. 23 is an end view of the deep end of the inlet pit of FIG. 20.
Figure 13:
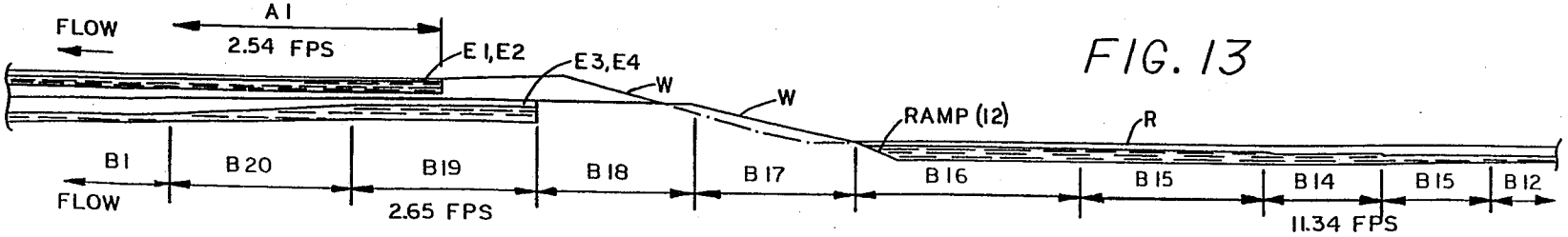
FIGS. 13 through 17 longitudinal cross sections of the channel configuration of FIG. 1.
Figure 14:
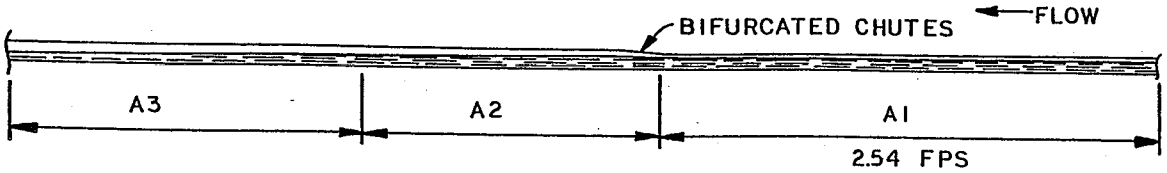
Figure 15:
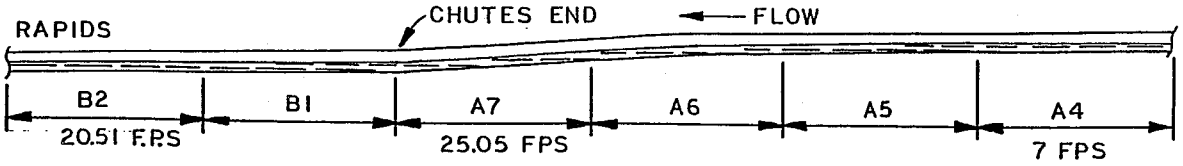
Figure 16:
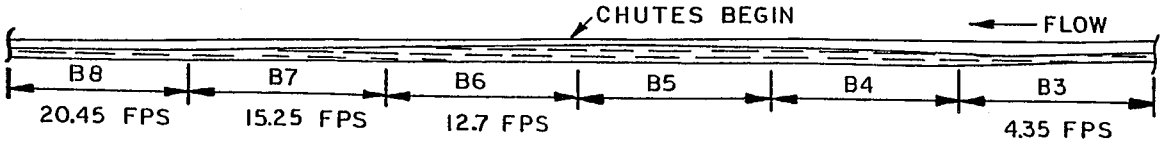
Figure 17:
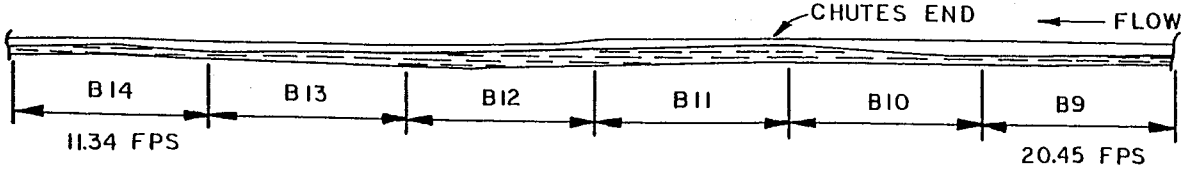
Figure 19:
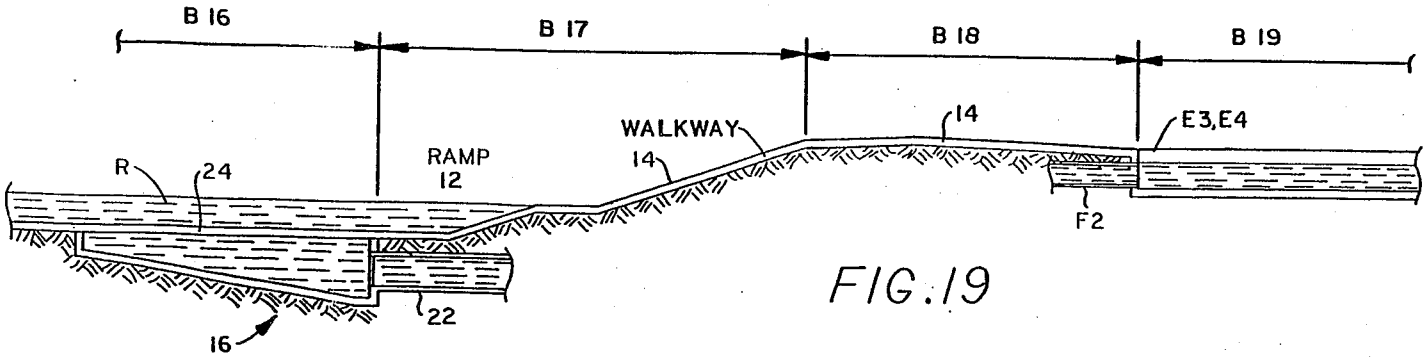
FIGS. 18 and 19 are longitudinal cross sections through the channel configuration showing the elevation of the main entryways relative to the reservoir.
Figure 18:
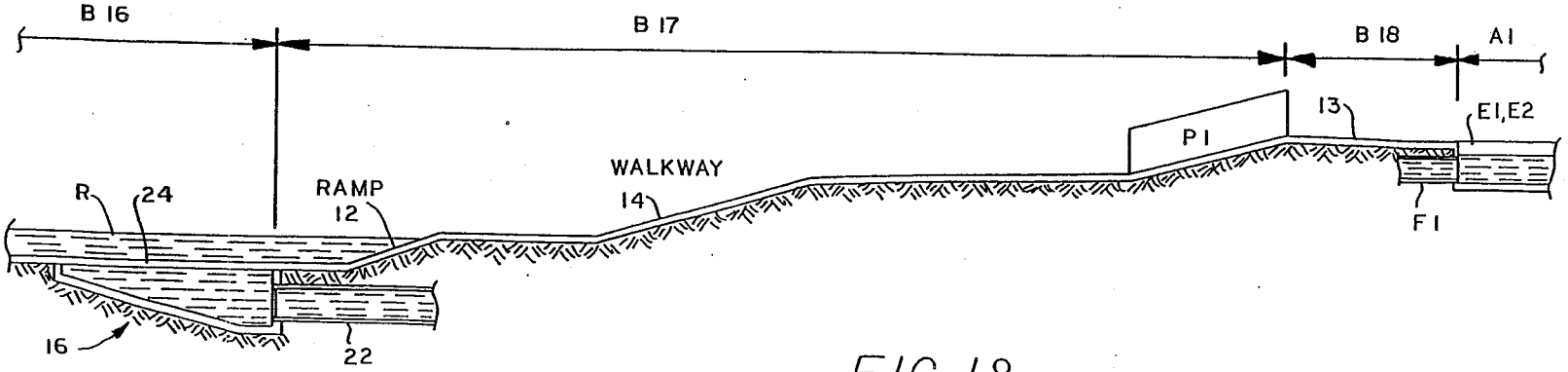

Referring to FIG. 1, one preferred form of a low rise water ride 10 embodying the present invention comprises a continuous waterway or channel C that follows a circuitous course. The channel trough is preferably constructed of concrete with a Gunnite finish. A preferred waterway course is configured generally in the form of an S-curve having an adjoining bottom loop which makes a complete 360° circle around a pond area or reservoir R and having a straight connecting portion which extends from the larger circle to the top of the S-shape.

The continuous waterway or channel C is divided into segments for purposes of description. The segments forming the connecting portion and top portion of the S-curve are designated A1 through A7. The segments forming the circular bottom loop are designated B1 through B20. The pond or reservoir R is divided into areas designated R1 through R3.

In the embodiment illustrated in FIG. 1, the straight portion or segment A1 which extends from the larger circle to the top of the S-shape is 130 feet long. The top curve of the S-shaped portion comprises segments A2, A3, A4, and A5. Segment A2 is 78.36 feet long, A3 is 100 feet long, A4 is 50 feet long, and A5 is 50 feet long. The lower curve of the S-shaped portion makes a 180° arc and is divided into two equal segments A6 and A7 which are 50 feet long each. The adjoining larger bottom loop which makes a complete 360° circle is divided into 20 equal segments B1 through B20 which are approximately 50 feet long each.

The size of the waterway or channel of the illustrated embodiment provides approximately 61,400 cubic feet of water in circulation at one time when the pumps are on. The total water volume is approximately 1.8 million gallons. The ride takes approximately 4 minutes.

Walkways W are located on both sides of the channel and extend outwardly a minimum distance of eight feet from each sidewall along the entire length of the channel. The walkways slope gradually downward into the channel to prevent water from standing, except at the areas adjacent the bifurcated chutes. Walkways adjacent the chute areas do not slope downward into the channel because of the extra height of the chute walls. However, these Walk Way areas may slope downhill in the downstream direction. The walkways are constructed of concrete and the surface is textured, or provided with a rubberized coating to aid in preventing slipping.

The pond area or reservoir R supplies the water for the channel and to be used for swimming, wading, sunbathing, diving and other water recreation. Pond area or reservoir R comprises a shallow central swimming area R1 for small children which gradually slopes down to the center at a ratio of 1 foot down over a 23 foot distance. Reservoir R is divided into two deeper areas R2 and R3 for use by older children and adults which may also be of sufficient depth to allow diving. Area R4 extends from the exit of the course back to the entrances and has an average depth of 3.5 feet. An elevated deck D extends circumferentially around the areas R2 and R3 and covers the outer 17.59 feet. The deck D may be used as a diving platform, sundeck, or a cover for the underlying area and it covers approximately 3,500 square feet.

Water is pumped through the segments A1 through A7 at a rate of 80,000 GPM (Gallons Per Minute) by an electric motor driven pump P1. Water is also pumped through the segments B1 through B19 at a rate of 125,000 GPM by a second electric motor driven pump P2. Pump P1 pumps the water to a height of 14.94 feet and pump P2 pumps the water to a height of 8.55 feet. Pumps P1 and P2 have check valves in a conventional manner. The preferred pumps are high volume horizontal axis flow pumps of the type normally used in flood control applications. The recirculating water is serviced by a conventional filter system.

When pumps P1 and P2 are off, the water in pond area or reservoir R extends to the inside wall 11 of the channel walk way W. When the pumps are on, the water recedes a distance approximately 17.59 feet from the inside wall of the channel walk way to expose a surrounding sloped walk way extending partially around the pond area or reservoir, as indicated in dotted line. This creates a beach type area B at its outer 17.59 feet and a very large area R1 of shallow water for children. The pond or reservoir covers such a large area such that the depth of the water will only decrease 0.87 feet with the pumps on from the depth with the pumps off.

There are eight generally rectangular entry areas E1 through E8 where participants may enter the channel. The entry areas are laterally spaced in pairs, one on each side of the channel. Two main entry areas E1 and E2 are located at the entrance to segment A1 and main entry areas E3 and E4 are located at the entrance to segment B19. Entry areas, E5 and E6 are located on the segment B4, and E7 and E8 on the segment B10. The water moving through segments B4 and B10 is moving at a slow rate and the entry areas also serve as exit areas where the participants may easily exit the course. Each entry area is 2 feet wide, 1.7 feet deep and approximately 20 feet long. The rear portion of each entry area, approximately four feet in length, tapers downwardly and inwardly into the channel for drainage and safety of the participants.

Referring now additionally to FIGS. 2–19, participants may enter the course at E1 or E2 at the entrance to segment A1, or E3 or E4 at the entrance to segment B19. Participants may also choose to enter the course at the slower moving area at E5 and E6 or E7 and E8. Segment A1 is a channel 20 feet wide with a water depth of 3.5 feet. When participants start at entry E1, they slowly float down stream a distance of 130 feet with 80,000 GPM of water at a speed of 2.54 FPS (Feet Per Second) and enter segment A2. Segment A2 is bifurcated into 2 chutes C1 and C2. Each chute is 6 feet wide and conducts approximately 40,000 GPM of water. As the participants float through segments A2, A3 and A4, the water velocity increases to 7 FPS and the water depth decreases to 2.1 feet. Segments A1 through A3 have straight sides and a flat bottom. Segments from A4 to A5 make a smooth transition from straight sides and flat bottom to a curved bottom, which provides more depth and improved flow to compensate for the increased velocity. The velocity of each segment through A7 is faster than the last which reaches 25.05 FPS in segment A7.

The end of segment A7 adjoins the segments forming the 360° bottom loop. The water leaving segment A7 at a velocity of 25.05 FPS mixes into the larger quantity of water flowing though the bottom loop at a rate of 125,000 GPM.

In the area where segment A7 adjoins segment B1 (FIGS. 6 and 7), the bottom of the channel makes a transition from the curve to a flat bottom having a 2 foot radius at the side-wall corner. The curved channel from segments B1 through B3 narrows to a width of 12 feet and a water depth of 2 feet and curves radially outward an inward along its length. The water velocity varies through B1 and becomes rapids through B2 and B3 with a velocity of 20.51 FPS. The channel makes a transition from segments B3 to B4 to a width of 30 feet with a water depth of 3.5 feet and back to straight sides and flat bottom to contain the slower moving water. The water velocity through B3 and B4 is 4.35 FPS.

Segment B6 is bifurcated into 2 chutes C3 and C4. Each chute is 6 feet wide and conducts approximately 102,500 GPM of Water. The water velocity increases to 12.7 FPS through segment B6 and to 15.25 FPS through segment B7. The chutes C3 and C4 curve radially outward and inward opposite one another along their length and from segments B7 through B8 the chutes make a smooth transition from straight sides and flat bottom to a curved bottom which provides more depth and improved flow to compensate for the increased velocity. The water velocity through segments B8 and B9 is 20.45 FPS at a water depth of 2.5 feet. At segment B10 the chutes become a single channel having the same Width, depth, and bottom configuration as segments B4 and B5 (described above) and continues through segment B11.

From segments B11 through B12 the channel narrows and curves radially outward and inward and makes a smooth transition back to the bottom configuration described above with reference to segments B2 and B3 causing rapids and continues through the first 25 feet of segment B14. Through the last 25 feet of segment B14 water velocity slows to 11.34 FPS causing the water depth to increase to 3.5 feet.

Segment B14 opens into the pond or reservoir area R4 which has an average depth of 3.5 feet. The participants are carried by the current through segments B14, B15, and B16. At segment B16 the participants are moving at a very slow rate and may either swim over to the pond or reservoir area where they can swim or they may walk up a submerged exit ramp 12 and sloped walk way 13 back to entrance E1 or E2 where they may be transported through the course again. The ride through the course takes approximately 4 minutes. Rather than standing in line, the participants may simply float back to the entrance of their choice.

Optionally, the participants may walk up another gently sloped walk way 14 to the entrance E3 or E4 at segment B19 which is only 8.55 feet higher than the reservoir. The entrance areas E1 and E2 at segment A1 are only an additional 6.39 feet higher than the entrance areas E3 and E4. Foot bridges 15 may be provided across the rapids and chute areas.

When participants enter the channel at E3 or E4 at the entrance of segment B19, they enter a channel 30 feet wide with a water depth of 3.5 feet and slowly float down stream at 2.65 FPS with 125,000 GPM of water to segment B20. The water flow at 80,000 GPM from segment A7 joins with the water flow at 125,000 GPM in segment B20 and becomes 205,000 GPM. From that point, the participant continues through the course as previously described.

Referring now additionally to FIGS. 20 through 24, inlet pits 16 to the pumps P1 and P2, are made into the bottom of the pond area in segment B16. For safety purposes, the inlet pits 16 are specially designed to let water enter slowly. Each pit 16 is a long narrow configuration having a sloping bottom wall 17, a short vertical wall 18 at one end, a longer vertical wall 19 at the opposite end, and opposed vertical side walls 20. A circular opening 21 in the longer end wall 19 receives a pump inlet pipe 22 which extends from the pit to the pump. The depth of the pit increases toward pump inlet pipe 22 for even flow. A plurality of removable vertical bars 23 extend across the circular opening to provide a grate for safety, and to prevent objects from being sucked into the pump.

The open top of each pit 16 is covered by a removable top or lid 24 comprising one or more rectangular precast reinforced concrete slabs 25 having a plurality of parallel plastic pipes extending vertically therethrough to form orifices. A preferred lid 24 utilizes a plurality of 2 inch diameter plastic pipes 26 on 4 inch centers. The total collective area of the orifices is approximately 1.5 times that of the pump inlet pipe 22. With the orifices on 4 inch centers, the surface ratio is approximately 7.5 to 1. The preferred pit is approximately 7 feet wide to provide support for the precast top slabs. The apertured top of the inlet pit to the pump is designed with the orifices spread over a large enough area to avoid dangerous currents, suctions, or vortexes.

As previously described, water is pumped to segment A1 at a rate of 80,000 GPM and to segment B1 at a rate of 125,000 GPM by electric motor driven pumps P1 and P2 which have check valves. The preferred pumps are high volume horizontal axis flow pumps of the type normally used in flood control applications.

Pump P1 pumps the water to a height of 14.94 feet through flume F1 and pump P2, pumps the water to a height of 8.55 feet through flume F2. Flumes F1 and F2 are underground flumes with concrete tops. The flumes F1 and F2 have retaining side walls for support and are used for water guides. The exit of each flume has a vertical grate for safety. The concrete tops of the flumes are also used as walkways.

The present invention moves large quantities of water a minimal elevation, creating a larger stream of fast moving water for rapids, chutes and channels. This is accomplished with high volume horizontal pumps at low heads, thus making it economically feasible. The present ride lifts 125,000 GPM only 8.55 feet, and 80,000 GPM only 14.94 feet, a total of 205,000 G.P.M. Most existing water rides lift smaller quantities of water much higher. It has more than 1,960 feet of rapids, chutes and channels, with speeds up to 25 FPS.

The water ride according to the present invention is safe, while maintaining an exciting, convenient and trouble free ride. It has enough depth, even in the fast areas, to prevent participants from scraping bottom. Fast moving areas are followed by slow areas for recovery. The continuous water flow eliminates large eddies that cause circulating traps. The exit to the water ride terminates closely to the entrance, whereby the participants may float back to the entrance eliminating the long walk back which is common with existing water rides. The ride takes approximately 4 minutes. The pond or reservoir area is large enough to hold water for the channels and the depth will change less than 1 foot with the pumps on, compared with the pumps off. The low rise water ride has a capacity of approximately 1.8 million gallons of water. The inlet pits to the pumps are designed to avoid dangerous currents, suctions, or vortexes. The present water ride will attract persons who like swimming and riding rapids, but do not like spending time walking, climbing and waiting in lines.

OPERATION

As previously described, the present water ride introduces a large predetermined quantity of water at an elevated portion of the channel which flows therethrough to a lower elevation. The quantity of water at the elevated portion has a weight substantially greater than the weight of the participant whereby the participant is moved by flow of the water through the course at a predetermined velocity while maintaining a depth sufficient to allow the participant to swim in the water or float on the water surface. Most other types of water rides utilize gravity acting on the participant and minimal amounts of water with the water primarily reducing friction on the incline. In prior art devices, the participant is moved relative to the water rather than floating on a large quantity of water.

In operation, the pumps are turned on to conduct a large quantity of water from the reservoir to the elevated portion of the channel at a predetermined rate. The size of the reservoir is such that the water height of the reservoir drops less than one foot when the pumps are running. In addition to supplying water for the course, the reservoir is located and sized for use for swimming, wading, sunbathing, diving and other water recreation. The continuous channel is configured along its length to have variations in depth, width, slope, and curvature to produce variations in the velocity and flow characteristic of the water flowing therethrough.

Participants may enter the channel at the entry ways on the elevated portion where the large quantity of water is being conducted, or at various other locations along the course where the water is moving slowly and after entering may swim or float on tubes through the course. The entry ways at the slow moving areas also allow the participant to exit the water. Each entry area is 2 feet wide, 1.7 feet deep and approximately 20 feet long and the rear 4 foot portion of each entry area tapers downwardly and inwardly into the channel for drainage and safety of the participants.

Assuming that participants enter the channel at the elevated entry E1 on the elevated portion, they enter a channel 20 feet wide having a depth of 3.5 feet and slowly float down stream with 80,000 GPM of water at a speed of 2.54 FPS (Feet Per Second). After a distance of 130 feet, the participant is propelled through one of two 6 foot wide chutes with 40,000 GPM of water. As the participants float through the chutes, the water velocity increases to 7 FPS and the water depth decreases to 2.1 feet. The bottom of the chutes make a transition from flat to curved and at the end of the S-curve the velocity has increased to 25.05 FPS.

The end of the S-curve joins into the 360° circular loop and the water moving at a velocity of 25.05 FPS mixes into the larger quantity of water flowing though the bottom loop at a rate of 125,000 GPM. At this point, the circular channel is decreasing from 30 feet wide to 12 feet wide and thereafter curves radially outward and inward along its length. The water velocity varies through this portion and becomes rapids with a velocity of 20.51 FPS. After the rapids, the channel increases to a width of 30 feet with a water depth of 3.5 feet and the water velocity slows to 4.35 FPS. Entry/exit areas in this section allow the participant to enter or exit at the slow moving portion.

After the slow moving section, the participant is propelled through one of two 6 foot wide chutes with 102,500 GPM of water. The chutes curve radially outward and inward opposite one another along their length and the depth gradually increases to compensate for the increased velocity. As the participants move through the chutes, the water velocity increases to 12.7 FPS and to 15.25 FPS about midway through the chutes and at the end of the chutes to 20.45 FPS with a depth of 2.5 feet.

At the end of the chutes, the channel again becomes a single channel having a width of 30 feet depth of 3.5 feet and the water velocity slows to 4.35 FPS. Entry/exit areas in this section allow the participant to enter or exit at the slow moving portion.

After the slow moving portion, the channel narrows and curves radially outward and inward and makes gradually decreases in depth causing rapids and continues for approximately the first 25 feet of the curved portion. Through the last 25 feet of the curved portion, the water velocity slows to 11.34 FPS increasing the water depth to 3.5 feet.

At the end of the curved portion, the channel opens into the outer portion of the pond or reservoir area which has an average depth of 3.5 feet. The participants are carried by the current through the curved portion and into the reservoir area. At this point, the participants are moving at a very slow rate and may either swim over to the pond or reservoir area where they can swim or they may walk up the submerged exit ramp 12 and sloped walk way 13 back to the elevated entrance E1 or E2 where they may be transported through the entire course again. The ride through the course takes approximately 4 minutes. Rather than standing in line, as is common with other water rides, the participants may simply float back to the entrance of their choice.

Optionally, the participants may walk up another gently sloped walk way 14 to the entrance E3 or E4 at on the circular portion which is only 8.55 feet higher than the reservoir. When participants enter the channel at E3 or E4 at the entrance of the circular portion, they enter a channel 30 feet wide with a water depth of 3.5 feet and slowly float down stream at 2.65 FPS with 125,000 GPM of water to the point at which the water flow at 80,000 GPM from the end of the S-curve joins with the water flow at 125,000 GPM in the circular portion and are propelled on a quantity of water moving at 205,000 GPM from that point, the participant continues through the course as previously described.

While this invention has been described fully and completely with special emphasis upon a preferred embodiment, it should be understood that within the scope of the appended claims the invention may be practiced otherwise than as specifically described herein.

I claim:

1. A water ride for human participants comprising;

a continuous channel having at least one course through which water is conducted, said channel having at least one elevated portion into which a large predetermined quantity of water is introduced for flow therethrough to a lower elevation and on which the participant is propelled, pump means for conducting a large quantity of water from a source of supply to the elevated portion of said channel at a predetermined rate, said channel and said pump means being interrelated in size and operated to maintain a continuously flowing body of water in said channel having a depth sufficient to permit a participant to float or swim thereon and substantially prevent such a floating or swimming participant from contacting the bottom of said channel, and entrance means on the elevated portion of said channel for allowing participants to enter the channel at the point through which the large quantity of water is being conducted.

2. A water ride according to claim 1 in which the rate at which said water is introduced into said elevated portion and channel slope therefrom are such a participant is moved through said course at selected velocities.

3. A water ride according to claim 1 including;

a water reservoir for supplying the water for said channel located and sized for use for swimming, wading, sunbathing, diving and other water recreation, and said pump means having an inlet in fluid communication ion with said reservoir for conducting water from said reservoir into the elevated portion of said channel at a rate sufficient to maintain said continuously flowing body of water in said channel having a depth sufficient to permit a participant to float or swim thereon and substantially prevent such a floating or swimming participant from contacting the bottom of said channel.

4. The water ride according to claim 3 in which the area of said reservoir being of sufficient size such that the water depth will change less than one foot on operation or cessation of operation of said pump means.

5. A water ride according to claim 1 in which said continuous channel configured along its length to have variations in depth, width, slope, and curvature to produce variations in the velocity and flow characteristic of the water flowing therethrough.

6. A water ride according to claim 5 in which said large quantity of water introduced into said elevated portion and the slope of the channel therefrom are such that a participant s moved through said circuitous course at predetermined velocities.

7. A water ride according to claim 5 including;

a water reservoir for supplying the water for said channel located and sized for use for swimming, wading, sunbathing, diving and other water recreation, and said pump means having an inlet in fluid communication with said reservoir for conducting water from said reservoir into the elevated portion of said channel.

8. The water ride according to claim 7 in which the area of said reservoir being of sufficient size such that the water depth will change less than one foot on operation or cessation of operation of said pump means.

9. The water ride according to claim 7 in which said water reservoir comprises a shallow central swimming area, and partitioned into one or more deeper areas for diving and other recreational water activities.

10. The water ride according to claim 9 including an elevated deck extending at least partially around the deeper areas of said reservoir for use as a diving platform, sundeck and cover for the underlying area.

11. A water ride for human participants comprising;

a continuous channel having at least one circuitous course through which water is conducted, said channel having at least one elevated portion into which a large predetermined quantity of water is introduced for flow therethrough to a lower elevation and on which the participant is propelled, the quantity of water at the elevated portion having a weight substantially greater than the weight of the participant whereby the participant is moved by flow of the water through the circuitous course at a predetermined velocity while maintaining a depth sufficient to allow the participant to swim in the water or float on the water surface, said channel having a first portion through which water flows at a first predetermined rate and a second portion adjoined thereto and in fluid communication therewith and through which water flows at a rate greater than the first rate, pump means for conducting a large quantity of water from a source of supply to the elevated portion of said channel at a predetermined rate comprising first pump means for conducting water through the first portion of said channel at the first predetermined rate and second pump means for conducting water through the second portion of said channel at the second predetermined rate, said channel and said pump means being interrelated in size and operated to maintain a continuously flowing body of water in said channel having a depth sufficient to permit a participant to float or swim thereon and substantially prevent such a floating or swimming participant from contacting the bottom of said channel, entrance means on the elevated portion of said channel for allowing participants to enter the channel at the point through which the large quantity of water is being conducted, said continuous channel configured along its length to have variations in depth, width, slope, and curvature to produce variations in the velocity and flow characteristic of the water flowing therethrough, a water reservoir for supplying the water for said channel located and sized for use for swimming, wading, sunbathing, diving and other water recreation, and partitioned into one or more deeper areas for diving and other recreational water activities, and said pump means having an inlet in fluid communication with said reservoir for conducting water from said reservoir into the elevated portion of said channel, main entry means on the first portion of said channel for allowing participants to enter the channel, and main entry means and exit means on the second portion of said channel for allowing participants to enter and exit the channel.

12. A water ride according to claim 11 in which said main entry means on the first portion of said channel is elevated a predetermined distance relative to the entry means on the second portion.

13. A water ride according to claim 11 in which said main entry means on the first portion of said channel is elevated a distance less than 7 feet above the main entry means on said second portion of said channel.

14. A water ride according to claim 11 including;

a water reservoir for supplying the water for said channel and also to be used for swimming, wading, sunbathing, diving and other water recreation, and the inlets for said first and second pump means in fluid communication with said reservoir for conducting water from said reservoir into said channel first and second portions respectively.

15. The water ride according to claim 14 in which the area of said reservoir being of sufficient size such that the water depth will change less than one foot on operation or cessation of operation of said pumps.

16. The water ride according to claim 14 in which said water reservoir comprises a shallow central swimming area, and partitioned into one or more deeper areas for diving and other recreational water activities.

17. The water ride according to claim 16 including an elevated deck extending at least partially around the deeper areas of said reservoir for use as a diving platform, sundeck and cover for the underlying area.

18. The water ride according to claim 11 in which the course of said channel is configured generally in the form of an S-curve with a complete 360° circle adjoining the bottom of the S-curve and a straight connecting portion which extends from the circle to the top of the S-curve, the first portion of said channel comprising the S-curve and connecting portion, and the second portion of said channel comprising the circle.

19. A water ride according to claim 18 including a water reservoir disposed centrally within the 360° circular portion of said channel for supplying the water for said channel and also to be used for swimming, wading, sunbathing, diving and other water recreation, and the inlets for said first and second pump means in fluid communication with said reservoir for conducting water from said reservoir into said channel first and second portions respectively, and the exit end of the second portion of said channel terminating in fluid communication with said water reservoir, and the reservoir has an inclined walk way leading back to the entry means on the circular portion and an adjoining walk way leading back to the entry means on the straight connecting portion.

20. The water ride according to claim 19 in which said water reservoir comprises a shallow central swimming area, and partitioned into one or more deeper areas for diving and other recreational water activities.

21. The water ride according to claim 19 including an elevated deck extending at least partially around the deeper areas of said reservoir for use as a diving platform, sundeck and cover for the underlying areas.

22. The water ride according to claim 19 in which the straight connecting portion of said first channel portion comprises a single channel with straight sides and a flat bottom having a participant entrance at one end and the opposed end curved to form the top of the S-curve, at the top of the S-curve, the single channel bi-furcated into two separate chutes each narrower than the width of the single channel and each having straight sides and a flat bottom, at the end of the S-curve the two separate chutes making a smooth transition from a flat bottom to a curved bottom, and joining into the second portion of said channel comprising the 360° circle, said channel second portion at the point where the two separate chutes join into the circular portion comprising a single wide channel of a width greater than the width of both separate chutes combined and gradually narrowing to a width less than the combined width of the two separate chutes, said single channel extending a distance partially around the circle and curving radially outward and inward and having straight sides and a flat bottom curved in the corners, at the end of the radially outward and inward curved portion said single channel gradually widening to a width greater than the radially outward and inward curved portion and extending a further distance partially around the circle and having secondary entry means adjacent each side, at a distance from the widened portion, the single wide channel is bifurcated into two separate chutes each narrower than the single wide channel and each having generally straight sides and a flat bottom, each chute continuing a further distance around the circle and curving radially outward and inward opposite one another along their length and each chute making a smooth transition from a flat bottom to a curved bottom, at the end of the separate radially outward and inward curved chutes said bi-furcated portion becoming a single channel widening to a width greater than the combined width of the two separate chutes combined and extending a further distance partially around the circle and then narrowing, said channel having secondary entry means adjacent each side, at the narrowed portion said single channel continuing a further distance partially around the circle and curving radially outward and inward and having straight sides and a flat bottom curved in the corners, at the end of the radially outward and inward curved portion said single channel emptying into the reservoir area, said reservoir inclined walk way leading back to the entry means on the circular portion and adjoining walk way leading back to the entry means on the straight connecting portion submerged at its lower end and circumferentially spaced from the point at which said single channel empties into the reservoir area, and said circular portion further comprising an arcuate channel with straight sides and a flat bottom having a participant entrance adjacent the reservoir at the top of said inclined walk way and extending around the circle to the point and gradually narrowing where the two separate chutes join into the circular portion, and thus completing the circular configuration.

23. The water ride according to claim 22 in which the straight connecting portion of said first channel portion is approximately 130 feet long and 20 feet wide and the top of the S-curve is an arcuate segment of approximately 250° and approximately 280 feet long and the bottom curve of the S-curve comprising an arc of approximately 180° and approximately 100 feet long, and said separate chutes each being approximately 6 feet wide, said channel second portion comprising at the point where said second curved portion joins thereinto a first arcuate segment approximately 150 feet long and 20 feet wide which gradually narrows to approximately 12 feet wide and thereafter curves radially outward and inward, thereafter gradually widening to an arcuate segment approximately 100 feet long and 30 feet wide, thereafter the single wide channel bifurcated into two separate chutes approximately 200 feet long and each approximately 6 feet wide, thereafter said bifurcated portion becoming a single arcuate channel approximately 100 feet long and widening to a width of approximately 30 feet wide and thereafter narrowing to a width of approximately 12 feet wide, thereafter curving radially outward and inward for a distance of approximately 150 feet, and thereafter emptying into the reservoir area, said reservoir inclined walk way leading back to the entry means on the circular portion rising to an elevation approximately 9 feet above said reservoir and said adjoining walk way leading back to the entry means on the straight connecting portion rising to an elevation of approximately 15 feet above said reservoir, and said arcuate channel having a participant entrance adjacent the reservoir at the top of said inclined walk way extending approximately 100 feet to the area where the two separate chutes join into the circular portion, and thus completing the circular configuration.

24. The water ride according to claim 19 in which the velocity of the water passing through the said first channel portion is less than 3 feet per second at the participant entry and gradually increases to approximately 7 feet per second through the two separate chutes at the top of the S-curve and to approximately 25 feet per second at the end of the S-curve, and the velocity of the water in said channel second portion at the point where the two separate chutes join into the circular portion is approximately 2.5 feet per second and gradually increasing through the radially curving outward and inward portion to approximately 20 feet per second through the widened portion at the end of the curved portion, the velocity of the water increasing through the two separate chutes which curve radially outward and inward opposite one another to approximately 12 feet per second at the first curve and to approximately 20 feet per second at the end of the curved portion, the velocity of the water decreasing at the end of the separate radially outward and inward curved chutes to approximately 4 feet per second through the wide channel and gradually increasing through the radially curving outward and inward portion to approximately 20 feet per second then decreasing to approximately 11 feet per second at the point where the curving portion empties into the reservoir area.

25. A water ride according to claim 19 in which the inlets for said first and second pump means each comprise a water inlet pit in the bottom of said reservoir connected by conduit art one end to said pump means, each said inlet pit having a generally rectangular configuration having a sloping bottom wall, a short vertical wall at one end, a longer vertical wall at the opposite end, and opposed vertical side walls with a circular opening in the longer end wall to receive a conduit which extends from the pit to the pump to which it is connected, said inlet pit having a grate across the circular opening of sufficient size to prevent objects from being sucked into the pump, and the open top of each pit covered by a removable lid having a plurality of parallel orifices extending vertically therethrough, the total collective area of the orifices being greater than the area of the pump inlet conduit.

26. A water ride according to claim 25 in which said lid constructed of reinforced concrete, and said orifices constructed of a plurality of parallel plastic pipes extending vertically through said lid.

27. The water ride according to claim 11 including walkways disposed at both sides of the channel and extending laterally outward therefrom along the length of said channel.

28. The water ride according to claim 11 in which said first and second pump means each comprise an electric motor driven pump including valve means, said first pump capable of pumping water to a height of at least 15 feet, and said second pump capable of pumping the water to a height of at least 9 feet.

* * * * *